US011457793B2

(12) United States Patent
Näßler et al.

(10) Patent No.: US 11,457,793 B2
(45) Date of Patent: Oct. 4, 2022

(54) WASHING CONTAINER FOR A DOMESTIC DISHWASHER, DOMESTIC DISHWASHER, AND METHOD

(71) Applicant: BSH Hausgeräte GmbH, Munich (DE)

(72) Inventors: Norbert Näßler, Aulendorf (DE); Andrzej Budzynski, Augsburg (DE); Dieter Hotz, Dischingen (DE); Johann Schabert, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 281 days.

(21) Appl. No.: 16/610,929

(22) PCT Filed: May 9, 2018

(86) PCT No.: PCT/EP2018/062035
§ 371 (c)(1),
(2) Date: Nov. 5, 2019

(87) PCT Pub. No.: WO2018/219615
PCT Pub. Date: Dec. 6, 2018

(65) Prior Publication Data

US 2020/0054186 A1 Feb. 20, 2020

(30) Foreign Application Priority Data

May 31, 2017 (DE) ..... 10 2017 209 241.6

(51) Int. Cl.
*A47L 15/42* (2006.01)

(52) U.S. Cl.
CPC ..... *A47L 15/4246* (2013.01); *A47L 15/4251* (2013.01)

(58) Field of Classification Search
CPC ..... A47L 15/4246; A47L 15/4251
See application file for complete search history.

(56) References Cited

U.S. PATENT DOCUMENTS

2009/0095335 A1 4/2009 Buehlmeyer et al.
2009/0126765 A1* 5/2009 Buehlmeyer ..... A47L 15/4268 134/115 R
2010/0192990 A1* 8/2010 Hotz ..... A47L 15/4246 134/115 R

FOREIGN PATENT DOCUMENTS

DE 102010038477 A1 * 2/2012 ..... A47L 15/4246
DE 102011004222 A1 8/2012

(Continued)

OTHER PUBLICATIONS

Machine English Translation of Description of WO 2014/191246 A1 (Busing) (Year: 2014).*

(Continued)

*Primary Examiner* — Joseph L. Perrin
*Assistant Examiner* — Irina Graf
(74) *Attorney, Agent, or Firm* — Michael E. Tschupp; Andre Pallapies; Brandon G. Braun

(57) ABSTRACT

A washing container for a household dishwasher includes a bottom plate and a U-shaped washing container jacket arranged on the bottom plate and including a side wall which is connected to the bottom plate by a folded joint. Connected to the washing container jacket is a U-shaped frame to support the washing container jacket. The frame has a support rib, which rises from the frame and is arranged within the washing container jacket and on which the folded joint is supported. The support rib has a closed support surface on which the folded joint lies.

20 Claims, 10 Drawing Sheets

(56) References Cited

FOREIGN PATENT DOCUMENTS

| | | | | |
|---|---|---|---|---|
| DE | 102011017635 | A1 | | 10/2012 |
| EP | 1138248 | A2 | | 10/2001 |
| KR | 20100068742 | A | * | 6/2010 |
| WO | 2014191246 | A1 | | 12/2014 |

OTHER PUBLICATIONS

International Search Report PCT/EP2018/062035 dated Aug. 10, 2018.

* cited by examiner

WASHING CONTAINER FOR A DOMESTIC DISHWASHER, DOMESTIC DISHWASHER, AND METHOD

CROSS-REFERENCES TO RELATED APPLICATIONS

This application is the U.S. National Stage of International Application No. PCT/EP2018/062035, filed May 9, 2018, which designated the United States and has been published as International Publication No. WO 2018/219615 A1 and which claims the priority of German Patent Application, Serial No. 10 2017 209 241.6, filed May 31, 2017, pursuant to 35 U.S.C. 119(a)-(d).

BACKGROUND OF THE INVENTION

The present invention relates to a washing container for a household dishwasher, a household dishwasher having such a washing container and a method for producing such a washing container.

A dishwasher generally has a washing container which is formed from a plurality of sheet metal portions connected together. The sheet metal portions may, for example, be welded or folded together. For example, the washing container comprises a base, in each case a side wall being fastened thereto at the side, and a rear wall terminating the washing container on the rear face. The washing container may be reinforced by means of a frame fastened thereto.

The publication WO 2007/048697 A1 discloses a dishwasher having at least one frame part which is made of plastic and which is fastened to a treatment container, wherein on the front face the treatment container has a filling opening which is closable by a door. The treatment container has a container jacket with side walls and a container top portion as well as the frame part, wherein the frame part forms a front surface of the treatment container and is positively connected to the container jacket.

BRIEF SUMMARY OF THE INVENTION

In view of this background, it is an object of the present invention to provide an improved washing container for a household dishwasher.

Accordingly, a washing container for a household dishwasher is proposed. The washing container comprises a bottom plate, a U-shaped washing container jacket, which is arranged on the bottom plate and comprises a side wall, which is connected to the bottom plate by means of a folded joint, and a U-shaped frame, which is connected to the washing container jacket and supports the washing container jacket, wherein the frame has a support rib, which rises from the frame and is arranged within the washing container jacket and on which the folded joint is supported, and wherein the support rib comprises a closed support surface on which the folded joint lies.

Since the support rib is provided with the closed support surface it is possible to provide a watertight folded joint, even in the region of the frame. In particular, when producing the folded joint the prevailing forces are absorbed by the frame without said frame being deformed. As a result, a lack of tightness of the folded joint in the region of the frame is reliably prevented.

A folded joint or crimped joint is to be understood, in particular, as a connecting technique in sheet metal processing. This connecting technique forms part of the group of techniques used for joining by means of reshaping. In this case, an edge of a metal sheet is bent back by a folding machine or crimping machine. As a result, a plurality of sheet metal parts may be connected together. It is to be understood by the washing container jacket being U-shaped that this washing container jacket comprises a first side wall, a second side wall and a top surface of the washing container arranged between the first side wall and the second side wall. The washing container jacket in this case is arranged on the bottom plate or placed thereon such that the U-shaped geometry of the washing container jacket is closed at the top and at the bottom. In other words, the U-shaped geometry is not arranged to lie horizontally on the bottom plate but to stand upright on said bottom plate. The bottom plate is preferably configured from a steel material which is different from that of the washing container jacket. For example, a more cost-effective material may be used for the washing container jacket than for the bottom plate. The frame is preferably produced from a plastics material. For example, the frame is a plastic injection-molded component. The frame is preferably provided on a loading opening of the washing container and stabilizes said loading opening. The frame is fixedly connected to the washing container jacket. It is to be understood by the support surface being closed, in particular, that the support surface has no raised portions, ribs, through-passages, recesses or any other type of structure. In other words, the support surface is preferably smooth. The support surface may be planar or curved.

According to one embodiment, the frame is arranged at least partially inside and at least partially outside the washing container jacket.

In particular, the frame is pushed onto the washing container jacket on the front face and fixedly connected thereto. In particular, the washing container jacket is inserted into the frame so that said frame is arranged at least partially inside and at least partially outside the washing container jacket.

According to a further embodiment, the folded joint bears over its entire surface against the support surface.

It is to be understood by the folded joint in the region of the support surface being in contact therewith, in particular, that no gap is provided between the folded joint and the support surface. Preferably, therefore, the folded joint bears without gaps against the support surface.

According to a further embodiment, the support surface is curved in an arcuate manner.

Alternatively, the support surface may also be flat or planar.

According to a further embodiment, the frame comprises a leakage water through-pas sage which is designed to guide leakage water from the support rib to a sealing element receiving portion of the frame.

In particular, a sealing element is received in the sealing element receiving portion, said sealing element circulating around the loading opening of the washing container. The leakage water through-passage penetrates the frame and passes from the support rib to the sealing element receiving portion and guides the leakage water to the rear of the sealing element into the sealing element receiving portion. The leakage water may thus be conducted downwardly in the sealing element receiving portion back into the washing container.

According to a further embodiment the leakage water through-passage passes through the frame.

The leakage water through-passage is configured, in particular, as a bore or through-passage. The leakage water through-passage may have any geometry.

According to a further embodiment, the support rib comprises a leakage water channel which is designed to supply the leakage water to the leakage water through-passage.

To this end the leakage water channel, in particular, is inclined in the direction of the leakage water through-passage. The leakage water channel is positioned, in particular, to the rear of the support rib.

According to a further embodiment, the frame comprises a leakage water guide rib which is designed to supply the leakage water to the leakage water channel.

The leakage water guide rib is preferably configured integrally with the support rib. The leakage water guide rib and the support rib form a Y-shaped geometry. The leakage water guide rib is positioned so as to be inclined in the direction of the leakage water through-passage.

According to a further embodiment, the frame is thermo-riveted to the washing container jacket.

To this end, a plurality of thermo-rivets are provided on the frame, said thermo-rivets being able to be configured integrally with the frame. The washing container jacket comprises corresponding through-passages, the thermo-rivets being passed through said through-passages. For connecting the frame to the washing container jacket, the thermo-rivets which are passed through the through-passages provided in the washing container jacket are fused thereon and pressed flat. As a result, the frame is fixedly connected to the washing container jacket.

According to a further embodiment, the washing container jacket comprises a first side wall which is connected to the bottom plate by means of a first folded joint, a second side wall which is connected to the bottom plate by means of a second folded joint, and a top surface which connects the first side wall to the second side wall.

The first side wall, the second side wall and the top surface form the U-shaped geometry of the washing container jacket. The washing container jacket is configured, in particular, as an integral curved sheet metal portion.

According to a further embodiment, the frame comprises a first support rib, the first folded joint being supported thereagainst, and a second support rib, the second folded joint being supported thereagainst.

In particular, a first leakage water guide rib is assigned to the first support rib and a second leakage water guide rib is assigned to the second support rib. Each support rib has a closed support surface, the corresponding folded joint being supported thereon.

According to a further embodiment, the frame is connected both to the first side wall and to the second side wall.

In particular, the frame is thermo-riveted both to the first side wall and to the second side wall. The frame is also preferably fixedly connected to the top surface of the washing container jacket, in particular thermo-riveted thereto.

According to a further embodiment, the washing container comprises a rear wall which is welded, in particular spot welded, to the bottom plate and the washing container jacket.

Preferably, the rear wall is produced from the same material as the washing container jacket. A sealing element is provided between the rear wall and the bottom plate and/or the washing container jacket, said sealing element sealing the rear wall in a watertight manner relative to the bottom plate and the washing container jacket.

A household dishwasher comprising such a washing container is further proposed.

A door may be fastened to the washing container, said door being pivotable about a pivot axis in order to open and to close the washing container. A plurality of receivers for items to be washed, for example three, may be provided in the washing container for items to be washed.

A method for producing a washing container for a household dishwasher is further proposed. The method comprises the steps: providing a bottom plate, a U-shaped washing container jacket and a U-shaped frame, connecting the frame to the washing container jacket and connecting a side wall of the washing container jacket to the bottom plate by means of a folded joint, wherein the folded joint during the production thereof is supported on a support rib of the frame which rises from the frame and is arranged within the washing container jacket, and wherein the support rib comprises a closed support surface, on which the folded joint lies during the production thereof.

It is to be understood by the support ribs rising out of the frame that the support rib protrudes over a base portion of the frame. Preferably, the frame is connected to the washing container jacket by means of a thermo-riveting method.

The features disclosed for the washing container and the household dishwasher accordingly apply to the method and vice-versa.

Further possible implementations of the washing container, the household dishwasher and/or the method also encompass combinations of features or embodiments described above or hereinafter relative to the exemplary embodiments which are not explicitly cited. In this case, the person skilled in the art will also add individual features as improvements or additions to the respective basic form of the washing container, the household dishwasher and/or the method.

Further advantageous embodiments and features of the washing container, the household dishwasher and/or the method form the subject-matter of the subclaims and the exemplary embodiments of the washing container, the household dishwasher and/or the method described hereinafter. The washing container, the household dishwasher and/or the method are described below in more detail by means of preferred embodiments with reference to the accompanying figures.

DETAILED DESCRIPTION OF EXEMPLARY EMBODIMENTS OF THE PRESENT INVENTION

Figure 1:
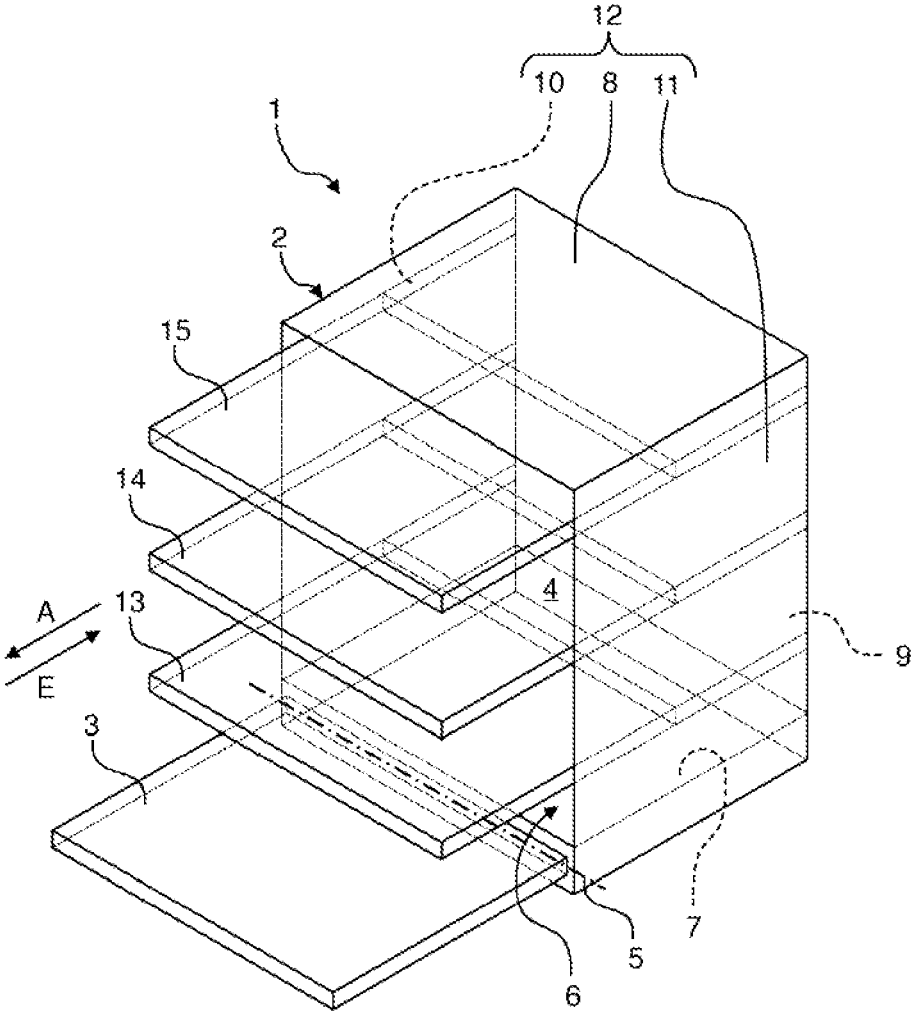
FIG. 1 shows a schematic perspective view of an embodiment of a household dishwasher.

Elements which are the same or functionally the same have been provided with the same reference numerals in the figures, unless indicated otherwise.

FIG. 1 shows a schematic perspective view of a household dishwasher 1. The household dishwasher 1 comprises a washing container 2 which is closable by a door 3, in particular in a watertight manner. To this end, a sealing apparatus may be provided between the door 3 and the washing container 2. The washing container 2 is preferably cuboidal. The washing container 2 may be arranged in a housing of the household dishwasher 1. The washing container 2 and the door 3 may form a washing chamber 4 for washing the items to be washed.

The door 3 is shown in FIG. 1 in the open position thereof. The door 3 may be closed or opened by pivoting about a pivot axis 5 provided at a lower end of the door 3. A loading opening 6 of the washing container 2 may be closed or opened by means of the door 3. The washing container 2 has a bottom plate 7, a top surface 8 arranged opposite the bottom plate 7, a rear wall 9 arranged opposite the closed door 3, and two side walls 10, 11 arranged opposite one another. The bottom plate 7, the top surface 8, the rear wall 9 and the side walls 10 may be produced, for example, from sheet steel. In particular, for example, the bottom plate 7 may be produced from a different material from the top surface 8 and the side walls 10, 11. For example, the bottom plate 7 may be produced from the material 1.4301, the top surface 8 and the side walls 10, 11 from the material 1.4016 and the rear wall 9 also from the material 1.4016.

A first side wall 10, a second side wall 11 and the top surface 8 arranged between the first side wall 10 and the second side wall 11 are configured in one piece, in particular integrally from the same material, and form a washing container jacket 12 of the washing container 2. The washing container jacket 12, the rear wall 9 and the bottom plate 7 are components which are produced separately from one another but which are connected together in a watertight manner. For example, the washing container jacket 12 is connected to the bottom plate 7 by means of a folded joint and the rear wall 9 is welded, in particular spot welded, to the washing container jacket 12 and to the bottom plate 7.

The household dishwasher 1 also has at least one receiver for items to be washed 13 to 15. Preferably, a plurality of receivers for items to be washed 13 to 15, for example three, may be provided, wherein the receiver for items to be washed 13 may be a lower receiver for items to be washed or a lower basket, the receiver for items to be washed 14 may be an upper receiver for items to be washed or an upper basket and the receiver for items to be washed 15 may be a cutlery drawer. As FIG. 1 further shows the receivers for items to be washed 13 to 15 are arranged superposed in the washing container 2. Each receiver for items to be washed 13 to 15 is optionally able to be displaced into or out of the washing container 2. In particular, each receiver for items to be washed 13 to 15 is able to be inserted in an insertion direction E (arrow) into the washing container 2 and counter to the insertion direction E (arrow) in a withdrawal direction A (arrow) out of the washing container 2.

Figure 2:
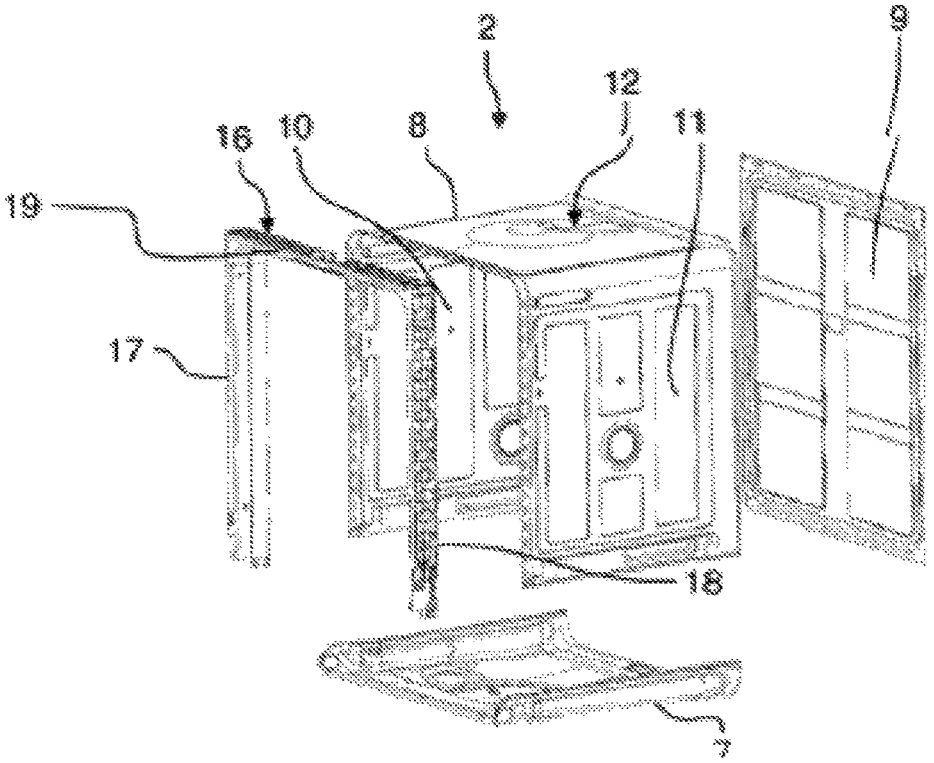
FIG. 2 shows a schematic perspective exploded view of an embodiment of a washing container for the household dishwasher according to FIG. 1.
Figure 3:
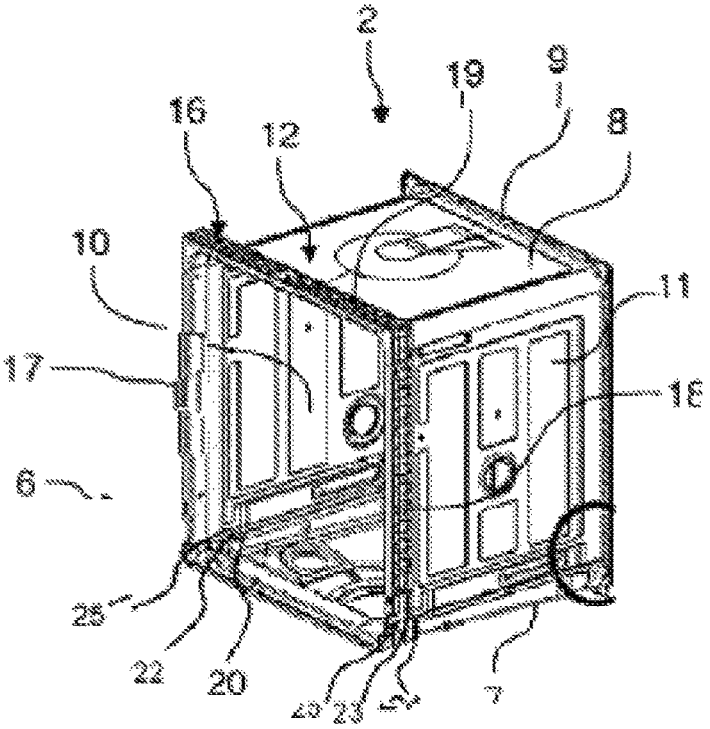
FIG. 3 shows a schematic perspective view of the washing container according to FIG. 2.

FIG. 2 shows a schematic perspective exploded view of an embodiment of the washing container 2 for the household dishwasher 1 according to FIG. 1. FIG. 3 shows a schematic perspective view of the washing container 2 according to FIG. 2. Hereinafter reference is made simultaneously to FIGS. 2 and 3.

In addition to the washing container jacket 12, the bottom plate 7 and the rear wall 9, the washing container 2 comprises a U-shaped frame 16 which supports the washing container jacket 12. To this end, the frame 16 is fixedly connected to the washing container jacket 12. In particular, the frame 16 is connected by means of thermo-riveting to the washing container jacket 12. The frame 16 is a plastic component. In particular, the frame 16 is a plastic injection-molded component. As a result, the frame 16 may be produced cost-effectively in large quantities. The frame 16 is designed such that said frame is provided on the loading opening 6 and is arranged at least partially inside the washing container jacket 12 and at least partially outside the washing container jacket 12.

As FIG. 3 shows, the frame 16 is pushed onto the loading opening 6 on the front face and thus reinforces the washing container jacket 12 in the region of the loading opening 6. The frame 16 comprises a first limb 17, a second limb 18 and an intermediate limb 19 which connects the first limb 17 to the second limb 18. The first limb 17 is fixedly connected to the first side wall 10, the second limb 18 is fixedly connected to the second side wall 11 and the intermediate limb 19 is fixedly connected to the top surface 8.

The first side wall 10 is connected to the bottom plate 7 by means of a first crimped joint or first folded joint 20 and the second side wall 11 is also connected to the bottom plate 7 by means of a second crimped joint or second folded joint 21. In the present case, folding or crimping is to be understood as a connecting technique in sheet metal processing. This connecting technique forms part of the group of techniques used for joining by means of reshaping. In this case, an edge of a metal sheet is bent back, for example, by means of a crimping machine or folding machine. As a result, a reinforcement of the bent-back edge is achieved and a joint which is made up of a plurality of sheet metal components may be provided. The folded joints 20, 21 extend in each case over the entire depth of the washing container 2, i.e. from the loading opening 6 to the rear wall 9.

Figure 4:
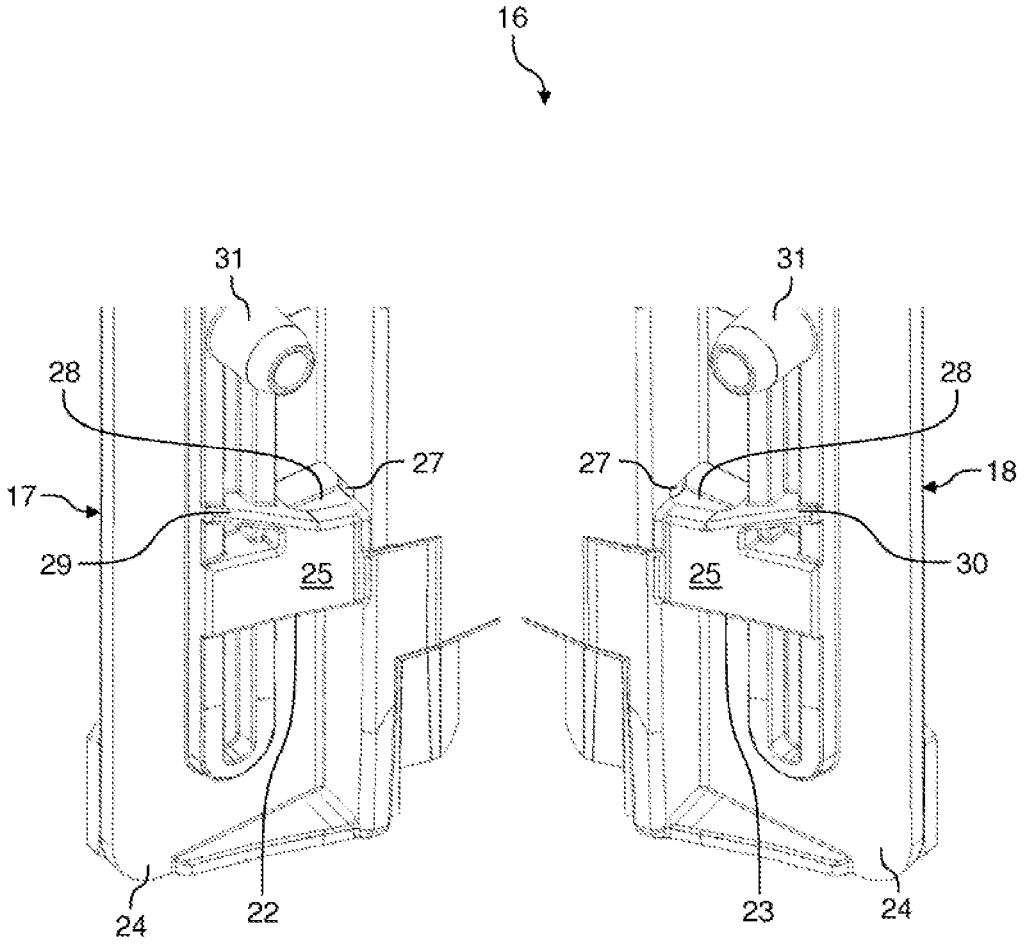
FIG. 4 shows a schematic perspective detailed view of a frame for the washing container according to FIG. 2.
Figure 5:
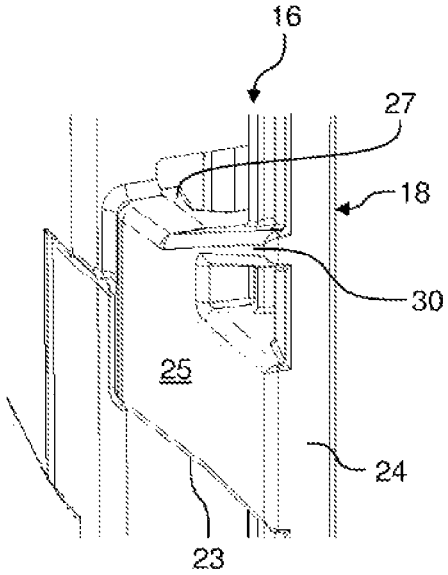
FIG. 5 shows a further schematic perspective partial view of the frame according to FIG. 4.
Figure 6:
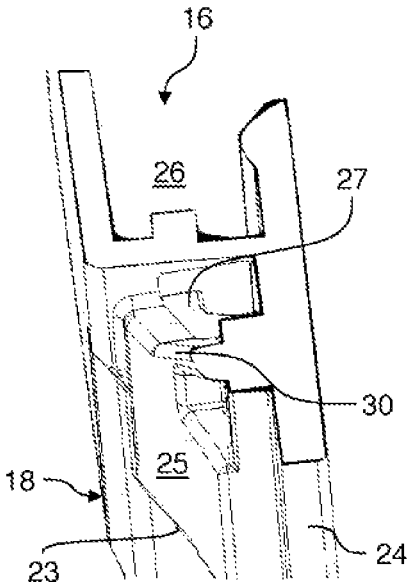
FIG. 6 shows a further schematic perspective partial view of the frame according to FIG. 4.

FIGS. 4 and 6 show in each case schematic perspective detailed views of the frame 16. The frame 16 comprises a support rib 22, 23 rising from the frame 16 and, in particular, from the respective limb 17, 18 and arranged inside the washing container jacket 12. The corresponding folded joint 20, 21 is supported on the respective support rib 22, 23. In particular, the first folded joint 20 is assigned to a first support rib 22 of the first limb 17 of the frame 16, and the second folded joint 21 is assigned to a second support rib 23 of the second limb 18 of the frame.

It is to be understood by the respective support ribs 22, 23 extending beyond the frame 16 that the support ribs 22, 23 are raised above one respective strip-shaped base portion 24 of the limbs 17, 18. Each support rib 22, 23 has a closed support surface 25. It is to be understood by the support surface 25 being closed that this support surface has neither bores, raised portions, ribs, channels, through-passages or the like. In other words, the support surface 25 is smooth. The support surface 25 in this case may be planar or curved. In particular, in the region of the respective support surface 25 of the support ribs 22, 23, the respective folded joint 20, 21 bears over its entire surface, i.e. over its whole surface, against the support surface 25.

The frame 16 further comprises a sealing element receiving portion 26, the aforementioned sealing device, for example a polyurethane seal, not shown, which circulates around the loading opening 6, being able to be received therein in order to seal the door 3 relative to the washing container 2. A leakage water through-passage 27 which may have any geometry is also provided in the frame 16. The leakage water through-passage 27 is designed to drain leakage water away from the respective support rib 22, 23 to the sealing element receiving portion 26. Such a leakage water through-passage 27 is assigned to each support rib 22, 23.

Thus in the sealing element receiving portion 26 the leakage water may flow down in the direction of gravity back into the washing container 2. To this end, the leakage water through-passage 27 penetrates the frame 16 and, in particular, the limbs 17, 18 of the frame 16. The support ribs 22, 23 also have in each case a leakage water channel 28 which is designed to supply the leakage water to the leakage water through-passage 27. To this end, the leakage water channel 28 is positioned in an inclined manner. The leakage water channel 28 may be positioned to the rear of the respective support rib 22, 23.

The frame 16 further comprises a first leakage water guide rib 29 assigned to the first limb 17, as well as a second leakage water guide rib 30 assigned to the second limb 18. In this case, the first leakage water guide rib 29 is configured in one piece with the first support rib 22 and the second leakage water guide rib 30 is configured in one piece with the second support rib 23. The leakage water guide ribs 29, 30 are positioned so as to be inclined, whereby the leakage water is supplied to the leakage water channel 28.

In FIG. 4 a thermo-rivet denoted by the reference numeral 31 may also be identified, the frame 16 being connected thereby to the washing container jacket 12. To this end, a plurality of bores or through-passages 32 (FIG. 7) is provided in the washing container jacket 12, the thermo-rivets 31 being passed therethrough. After attaching the frame 16 to the washing container jacket 12 the thermo-rivets 31 are fused thereon and pressed flat. As a result, the frame 16 is fixedly connected to the washing container jacket 12.

Figure 7:
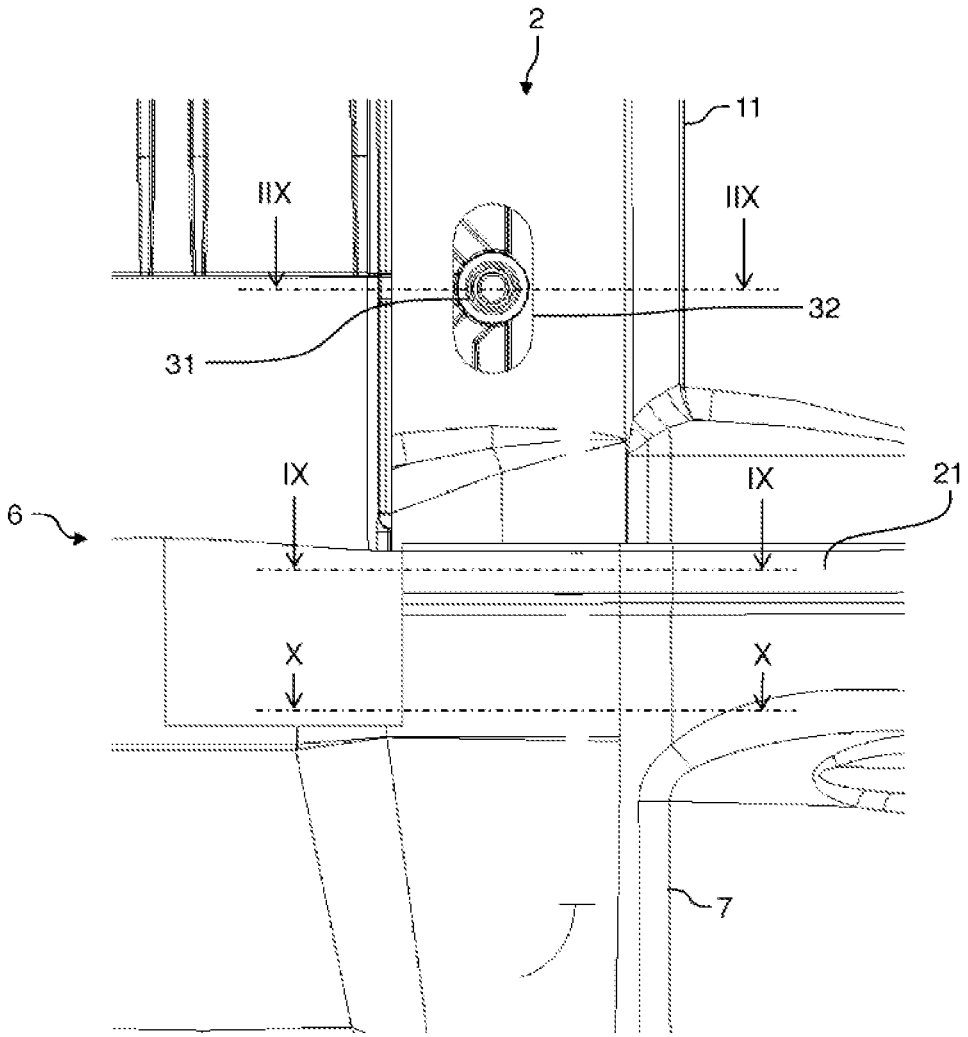
FIG. 7 shows a schematic detailed view of the washing container according to FIG. 2.
Figure 8:
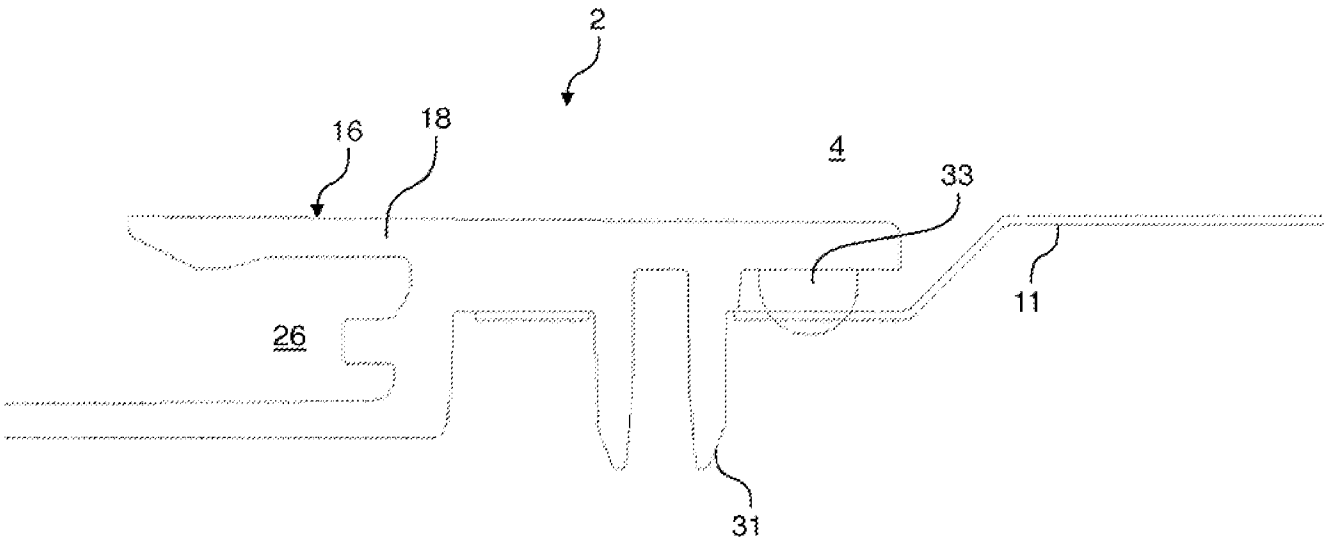
FIG. 8 shows the sectional view IIX-IIX according to FIG. 7.
Figure 9:
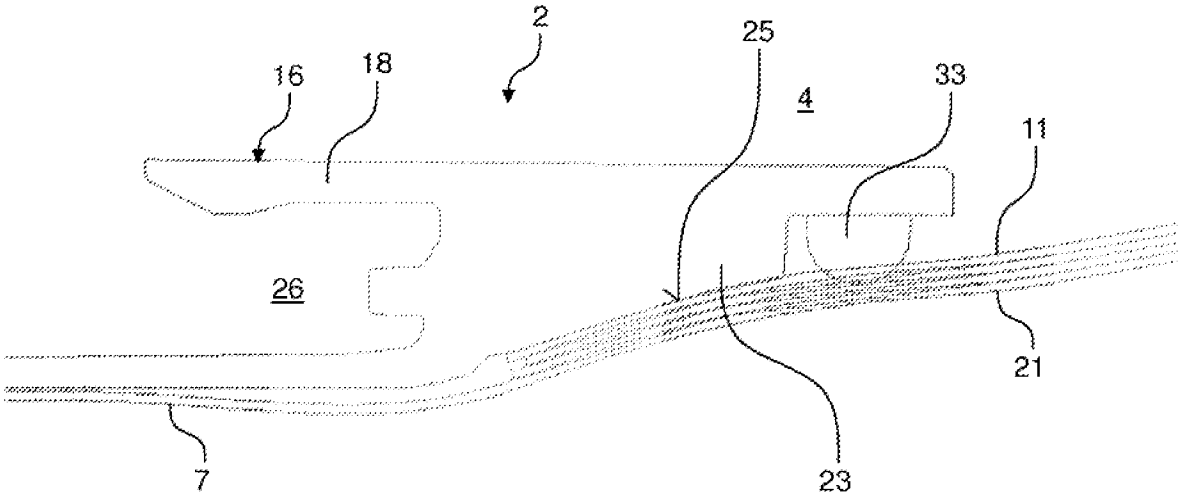
FIG. 9 shows the sectional view IX-IX according to FIG. 7.
Figure 10:
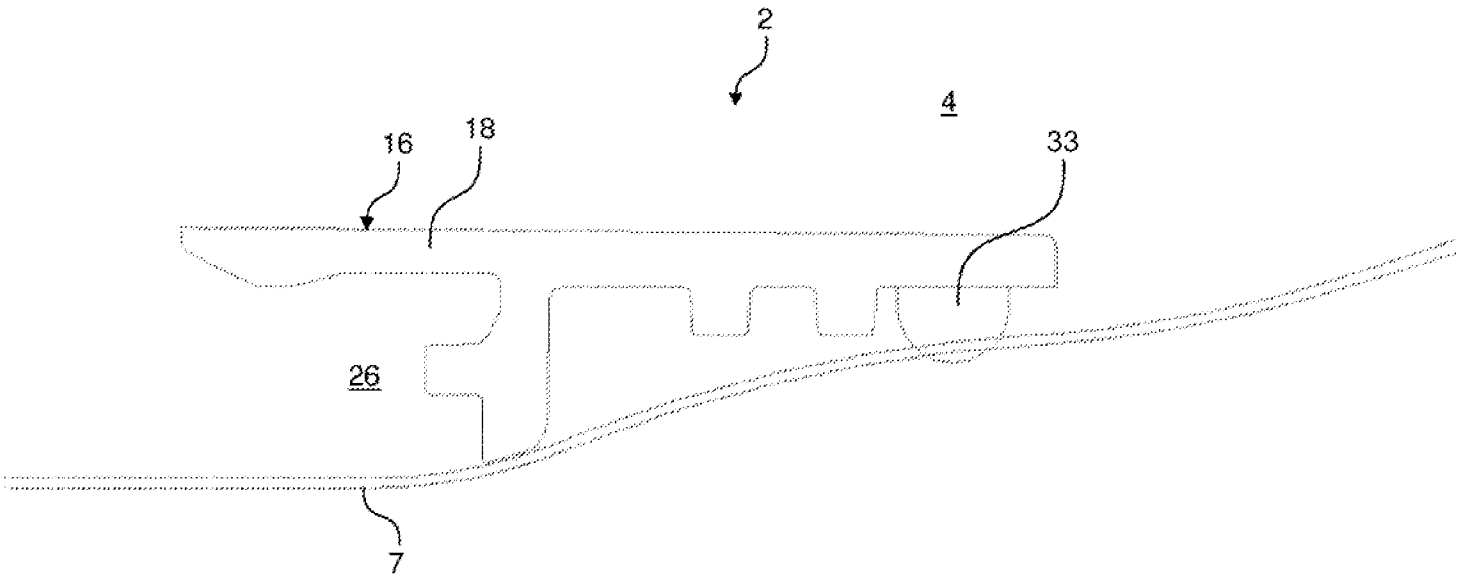
FIG. 10 shows the sectional view X-X according to FIG. 7.

FIG. 7 shows a schematic enlarged side view of the washing container 2. FIG. 8 shows the sectional view IIX-IIX according to FIG. 7. FIG. 9 shows the sectional view IX-IX according to FIG. 7 and FIG. 10 shows the sectional view X-X according to FIG. 7. Hereinafter reference is made simultaneously to FIGS. 7 to 10.

A sealing element 33 which is designed to seal the frame 16 relative to the washing container jacket 12 in a watertight manner is shown in FIGS. 8 to 10. The sealing element 33 is arranged inside the washing container 2. In FIG. 9 it may be identified that the support surface 25 of the support ribs 22, 23 is curved. However, the support surface 25 may be also linear. In particular, the support surface 25 is curved in an arcuate manner. The corresponding folded joint 20, 21 bears over its entire surface against the respective support surface 25, so that in the region of the support ribs 22, 23 the respective folded joint 20, 21 preferably bears without gaps against the support surface 25 assigned thereto.

Figure 11:
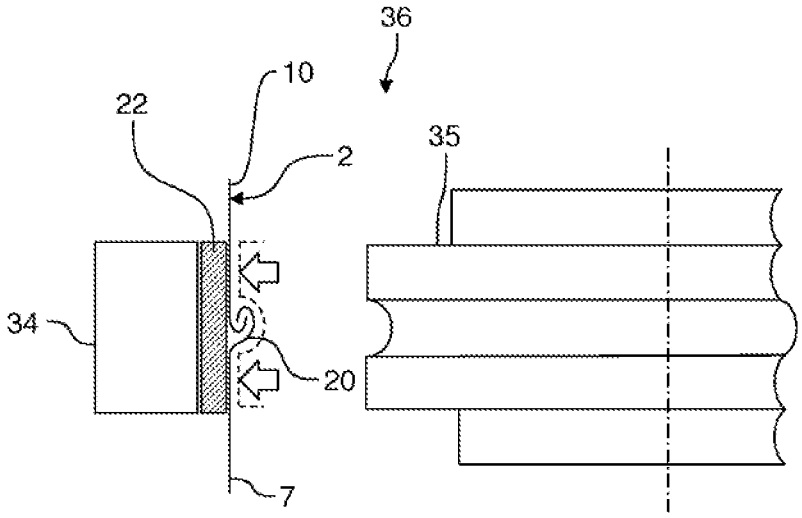
FIG. 11 shows a schematic view of a folding machine for producing the washing container according to FIG. 2.

FIG. 11 shows schematically the functionality of the support ribs 22, 23 when producing the folded joints 20, 21. When producing the folded joints 20, 21 the frame 16 is supported on the inner face by a counter-support 34. The respective folded joint 20, 21 is formed on the outer face by means of a crimping roller or folding roller 35. Since the support ribs 22, 23 are provided, in the region of the support ribs 22, 23, the folded joint 20, 21 bears fixedly thereagainst during the production thereof, whereby the folding process is simplified. For producing the folded joints 20, 21 the folding roller 35, as shown in FIG. 11 by means of arrows and a view of the folding roller 35 in dashed lines, is moved toward the washing container 2 and is moved along the washing container 2, for example from the rear wall 9 in the direction of the loading opening 6, wherein the respective folded joint 20, 21 is formed by deforming the bottom plate 7 and the respective side wall 10, 11. The counter-support 34 and the folding roller 35 may be part of a crimping machine or a folding machine 36.

Figure 12:
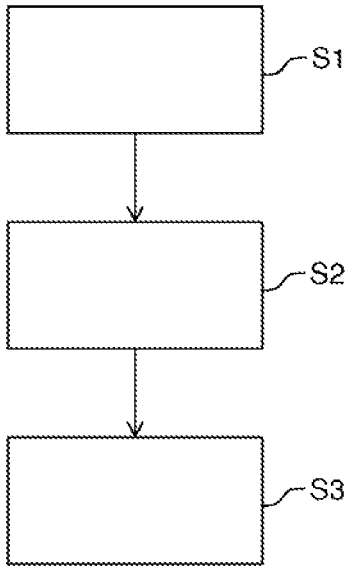
FIG. 12 shows a schematic block diagram of an embodiment of a method for producing the washing container according to FIG. 2.

A production method for producing the washing container 2, for example by means of the folding machine 36, is shown schematically in FIG. 12 by means of a block diagram. In a step S1 the bottom plate 7, the U-shaped washing container jacket 12 and the U-shaped frame 16 are provided. In step S1, for example, the bottom plate 7 may be deep-drawn. In a step S2 the frame 16 is connected to the washing container jacket 12. This may be carried out by means of a thermo-riveting method. In a further step S3 the side walls 10, 11 of the washing container jacket 12 are connected to the bottom plate 7 by means of the respective folded joint 20, 21. In this case, the respective folded joint 20, 21 is supported on the support rib 22, 23 of the frame during the production thereof, said support rib rising out of the frame 16 and being arranged within the washing container jacket 12. The folded joint 20, 21 during the production thereof bears without gaps against the closed support surface 25.

By means of the above-described frame 16 it is possible to implement folding technology on a washing container 2 comprising a frame 16 made of plastic material. As the folded joints 20, 21 bear over their entire surface against the support surfaces 25, visible damage to the frame 16 may be prevented during the folding process. Moreover, a reliable absorption of the forces during the folding process is also ensured without simultaneous deformation of the folded joints 20, 21. A lack of tightness in the folded joints 20, 21 is reliably prevented in the region of the frame 16.

The tightness between the sealing element 33 attached to the frame 16 and the folded joint 20, 21 is always ensured. The geometry of the support surface 25 permits the use of different folding methods. For example, a static or dynamic folding method may be used. The geometry of the support surface 25 further permits the use of different sealing means. For example, a silicone seal may be applied, a seal made from a thermoplastic elastomer may be injection-molded thereon or other types of seals may be adhesively bonded thereto.

Whilst the present invention has been described with reference to exemplary embodiments, it may be modified in many different ways.

The invention claimed is:

1. A washing container for a household dishwasher, said washing container comprising:

a bottom plate;

a U-shaped washing container jacket arranged on the bottom plate and comprising a side wall connected to the bottom plate by a folded joint; and a U-shaped frame connected to the washing container jacket and supporting the washing container jacket, said frame having a support rib, which extends from the frame, on which the folded joint is supported, the support rib arranged within the washing container jacket, said support rib comprising a vertically oriented support surface, a portion of the folded joint configured to bear against the vertically oriented support surface for forming a watertight seal.

2. The washing container of claim 1, wherein the frame is arranged at least partially inside and at least partially outside the washing container jacket.

3. The washing container of claim 1, wherein the folded joint bears over its entire surface against the support surface.

4. The washing container of claim 1, wherein the support surface is curved in an arcuate manner.

5. The washing container of claim 1, wherein the frame comprises a leakage water through-passage configured to guide leakage water from the support rib to a sealing element receiving portion of the frame.

6. The washing container of claim 5, wherein the leakage water through-passage is configured to pass through the frame.

7. The washing container of claim 5, wherein the support rib comprises a leakage water channel configured to supply the leakage water to the leakage water through-passage.

8. The washing container of claim 7, wherein the frame comprises a leakage water guide rib configured to supply the leakage water to the leakage water channel.

9. The washing container of claim 1, wherein the frame is thermo-riveted to the washing container jacket.

10. The washing container of claim 1, wherein the side wall of the washing container jacket is a first side wall connected to the bottom plate by the folded joint, said washing container jacket comprising a second side wall connected to the bottom plate by a folded joint, and a top surface which connects the first side wall to the second side wall.

11. The washing container of claim 10, wherein the support rib of the frame is a first support rib upon which the folded joint to connect the first side wall of the washing container jacket to the bottom plate is supported, said frame comprising a second support rib upon which the folded joint to connect the second side wall of the washing container jacket to the bottom plate is supported.

12. The washing container of claim 10, wherein the frame is connected both to the first side wall and to the second side wall.

13. The washing container of claim 1, further comprising a rear wall welded to the bottom plate and the washing container jacket.

14. The washing container of claim 13, wherein the rear wall is spot welded to the bottom plate and the washing container jacket.

15. A household dishwasher, comprising a washing container, said washing container comprising a bottom plate, a U-shaped washing container jacket arranged on the bottom plate and comprising a side wall connected to the bottom plate by a folded joint, and a U-shaped frame connected to the washing container jacket and supporting the washing container jacket, said frame having a support rib, which extends from the frame, on which the folded joint is supported, the support rib arranged within the washing container jacket, said support rib comprising vertically oriented support surface, a portion of the folded joint configured to bear against the vertically oriented support surface for forming a watertight seal.

16. A method for producing a washing container for a household dishwasher, said method comprising:

forming a support rib on a U-shaped frame such that the support rib extends from the frame;

connecting the U-shaped frame to a washing container jacket such that the support rib is arranged within the washing container jacket; and connecting a side wall of the washing container jacket to a bottom plate by a folded joint such that the folded joint during production thereof is supported on vertically oriented support surface of the support rib for forming a watertight seal.

17. The method of claim 16, wherein the frame is connected to the washing container jacket such that the frame is arranged at least partially inside and at least partially outside the washing container jacket.

18. The method of claim 16, wherein the frame is connected to the washing container jacket by thermo-riveting.

19. The method of claim 16, further comprising:

connecting a further side wall of the washing container jacket to the bottom plate by a folded joint; and connecting the side wall and the further side wall by a top surface.

20. The method of claim 16, further comprising welding a rear wall to the bottom plate and the washing container jacket.

* * * * *